US008297200B2

(12) United States Patent
Wolinski et al.

(10) Patent No.: US 8,297,200 B2
(45) Date of Patent: Oct. 30, 2012

(54) AXLEBOX RETAINER KEY, AN ASSEMBLY INCLUDING THE KEY AND A METHOD OF FASTENING THE KEY

(75) Inventors: Joseph Wolinski, Metford (AU); Douglas Gordon Cummings, Coal Point (AU)

(73) Assignee: Bradken Resources Pty Limited, Mayfield West (AU)

( * ) Notice: Subject to any disclaimer, the term of this patent is extended or adjusted under 35 U.S.C. 154(b) by 396 days.

(21) Appl. No.: 11/996,704

(22) PCT Filed: Jul. 26, 2006

(86) PCT No.: PCT/AU2006/001041

§ 371 (c)(1), (2), (4) Date: Jul. 16, 2008

(87) PCT Pub. No.: WO2007/012116

PCT Pub. Date: Feb. 1, 2007

(65) Prior Publication Data

US 2009/0200817 A1 Aug. 13, 2009

(30) Foreign Application Priority Data

Jul. 26, 2005 (AU) ..... 2005903964

(51) Int. Cl.
*B61F 5/26* (2006.01)

(52) U.S. Cl. ..... 105/221.2; 105/219

(58) Field of Classification Search ..... 105/218.1, 105/219, 220, 221.1, 221.2
See application file for complete search history.

(56) References Cited

U.S. PATENT DOCUMENTS 1,799,943 A * 4/1931 Alden ..... 295/36.1
2,090,975 A * 8/1937 Couch ..... 105/219

(Continued)

FOREIGN PATENT DOCUMENTS

FR 227480 8/1975

OTHER PUBLICATIONS

International Search Report from International Application No. PCT/AU2006/001041 completed Aug. 17, 2006, and mailed on Aug. 30, 2006.

*Primary Examiner* — Jason C Smith
(74) *Attorney, Agent, or Firm* — Heslin Rothenberg Farley & Mesiti P.C.

(57) ABSTRACT

An axlebox retainer key (50) is disclosed for fitting to a pedestal leg (24) of a sideframe of a rail wagon bogie. The key (50) comprises a body which has a basal projection (52) which extends in use into a cavity or hole (42) which is formed in the pedestal leg (24). The key (50) also has an upper surface recess (60) which is arranged to receive a locking pin (66) which can be axially inserted to maintain the key (50) at the pedestal leg (24). The locking pin (66) is also inserted via the pedestal leg side wall (30) which incorporates a through-hole (82) through which the locking pin (66) is passed. To install the key (50), an operator first positions the basal projection (52) of the key (50) in the cavity or a hole (42) that is formed in the pedestal leg (24), and then moves the locking pin 66 across the key (50) via the through-hole (82) in the side wall (30) so as to secure the key (50) to the pedestal (24).

27 Claims, 12 Drawing Sheets

U.S. PATENT DOCUMENTS 2,424,327 A * 7/1947 Nystrom et al. ..... 105/221.1
3,521,570 A * 7/1970 Hasten, Jr. ..... 105/221.2
3,841,229 A * 10/1974 Smith et al. ..... 105/221.2
3,841,231 A * 10/1974 Hlinsky ..... 105/221.2
3,905,307 A * 9/1975 MacDonnell et al. ..... 105/221.2
3,924,541 A * 12/1975 MacDonnell et al. ..... 105/221.2
4,072,112 A * 2/1978 Wiebe ..... 105/221.2
5,746,137 A * 5/1998 Hawthorne et al. ..... 105/219
2009/0200817 A1* 8/2009 Wolinski et al. ..... 295/43
2010/0064930 A1* 3/2010 Schorr et al. ..... 105/224.1

* cited by examiner

AXLEBOX RETAINER KEY, AN ASSEMBLY INCLUDING THE KEY AND A METHOD OF FASTENING THE KEY

CROSS-REFERENCE TO RELATED APPLICATIONS

This application is a national stage of PCT International Application No. PCT/AU2006/001041 filed on Jul. 26, 2006, and published in English on Feb. 1, 2007 as International Publication No. WO 2007/012116 A1, which claims priority to Australian Patent Application No. 2005903964 filed on Jul. 26, 2005, the entirety of which are all hereby incorporated herein by reference.

FIELD OF THE INVENTION

The present invention relates generally to an axlebox retainer key for use with a sideframe of a rail wagon bogie, to an assembly which includes the key and to a method of fastening said key to be secured to the sideframe.

BACKGROUND TO THE INVENTION

Railway freight wagons are supported by a railway bogie. Referring to the prior art arrangement shown in FIGS. 1, 2 and 3 of the present specification, the bogie 10 includes a pair of sideframes 12 spaced apart by a bolster onto which the wagons are mounted. Opposing ends 14, 16 of each bogie sideframe 12 are arranged for mounting to an axle of a wheelset 8 via an inverted U-shaped adapter bushing 18 which in turn supports a bearing 20. Each adapter bushing 18 is seated on an upper side region of a respective bearing 20 and is also fastened to a respective sideframe end 14, 16 so that the bearing 20 cannot move longitudinally or laterally out of alignment when the rail wagon is in motion. The adapter bushing 18 is located in a corresponding U-shaped cut-out 22 of the sideframe end 14, 16, the U-shaped cut-out 22 defined by two pedestal legs 24, 26. The bearings 20 for the axles are located at the distal ends of each axle on an in use outermost side of the sideframe 12, and a respective wheel 8 is positioned on an in use innermost side of each sideframe 12.

In the prior art configuration shown in FIG. 1, the inner pedestal leg 24 of the sideframe 12 comprises two generally elongate and parallel side walls 30, 32 with a generally horizontal flange 34 extending therebetween to form a saddle, and it is onto the flange 34 which the known axlebox retainer key 36 is seated and fastened. The axlebox retainer key 36 is shown as a basic rectangular prism with one generally tapering end shaped as a tang 28 having a flat uppermost face portion 38 thereon. The key 36 is positioned between the parallel side walls 30, 32 of the pedestal leg 24 so as to protrude some distance in a direction toward the bearing 20. The face portion 38 of the key 36 is arranged to be approximately tangential to, and located a small clearance from, a periphery of the bearing 20. The key 36 is fastened to the horizontal flange 34 of the pedestal leg 24 using a bolt 40 located in a through-hole 42 in the flange 34, and the bolt 40 is fastened by a nut 44, as can be seen in the prior art FIGS. 1, 2 and 3.

In use, when rail wagon and bogie 10 are lifted up (for example when lifted by a crane, or when being lifted for subsequent inversion for dumping any bulk contents of the wagon) the wheelset 8 must also be lifted therewith. The four axlebox retainer keys 36 on a bogie 10 (ie. two on each sideframe 12 in a pair of sideframes) restrain the bearings 20 (and therefore the wheelset 8 and axle) from falling under the influence of gravity out of the U-shaped cut-out 22 of the sideframe 12. When the rail wagon is lifted, the bearing 20 will move under the weight of the wheelset 8 and axle to rest against the uppermost face portion 38 of the axlebox retainer key 36, and no further downward movement of the axle and wheelset 8 can then occur.

There are normally four axlebox retainer keys 36 for each bogie. During maintenance, which is typically necessary sometime after 9 to 36 months in service depending on the wheel wear rate, all of the keys 36 need to be removed to free the wheelsets 8 for re-profiling of the tread contour. Normally this accomplished by the use of tools such as a spanner or an impact gun to loosen off the nut 44. The access to the nut 44 is from directly underneath the sideframe 12, which can result in lower back strain and sore knees for a maintenance worker, especially if that worker is required to handle up to 10 or 20 wagons a day in a single shift at a maintenance workshop.

In addition, the mounting bolt arrangement is not dependable because the vibrations associated with normal operation of the bogie can work the nut loose and allow the bolt to pop out. The key then easily falls out when the bolt is gone.

SUMMARY OF THE INVENTION

In a first aspect, the present invention provides an axlebox retainer key for fitting to a pedestal leg of a sideframe of a rail wagon bogie, the key comprising:

- a body having an upper side and an underside;
- a locating projection which extends from the underside of the body for location in a cavity or hole which is formed in the pedestal leg; and
- a retaining formation formed at the upper side of the body and defining a transverse groove, which is arranged to extend across the key.

One advantage of having such a locating projection is that it obviates the need for a nut and bolt type fastening arrangement for the key. The projection can be used as a guide for the initial step of locating the key in position at the pedestal and can also be used to limit any movement of the key relative to the pedestal (either sideways or vertical) when used in combination with the locking member.

The use of a projection means that no mechanical device or tool (such as an 8 kg impact gun) is required to enable removal of the retaining key, and that there is no need for an operator to kneel on the ground or to hold a tool in an inverted position for loosening or tightening of a nut whilst restraining the head of the bolt. This means that the retainer keys can be simply changed out in the train yard, rather than needing to go to the expense and time of bringing the whole bogie into a maintenance workshop area. The vibration problem of the prior art nut and bolt arrangement is also solved by eliminating the need for such components.

In one embodiment, the projection can be integral with the body and be formed out of the same mass by cutting or other shaping methods, or techniques such as casting. In an alternative embodiment, the projection can be welded or otherwise formed integral with the body. By having an integral projection that is cast as part of the key, the key can have a greater inherent strength compared with prior art arrangements which use a discrete fastener, and may even be able to be made of a thinner material that can therefore be lighter overall. If a cast connector component is made, because no joining or welding is required the component can also be simpler and cheaper to make because of the reduced number of manufacturing steps compared with a welded product. For example, the cast components can be cast in a single step.

However it is within the scope of the invention for the connector components to be formed by processes other than casting, such as by welding.

In one embodiment, the projection can be a basal spigot located on an underside of the body. One preferred arrangement features a round spigot on the key which, when in position, drops into the cored hole in the pedestal leg flange that is currently used to accept the bolt and nut of the prior art fastening arrangement. In some embodiments the spigot can be arranged to have a diameter which can fit into the cored hole quite tightly (close tolerances) to minimise any slight degrees of movement of the key.

In one embodiment, the said recess can be arranged on an in use upper side of the body, and may be arranged of a shape that is suitable for the receipt of a locking member which is axially displaced across the upper surface of the body. In one form the recess can be a closed-end cavity for receiving the end of an elongate locking member, whilst in other forms the recess can be a hollow or cut-out that is located at an upper surface of the body. In such arrangements when the locking member is received in the recess it can inhibit removal of the projection from the cavity, with the effect that the key is restrained from movement in any direction (i.e. either upwardly, or in a lateral or axial direction). In one arrangement, the locking member may be an axially slidable pin which is insertable into the recess via a through-hole in the front face of the sideframe.

In another form, the retaining portion formed at the body to receive the locking member can be a through-hole arranged of a suitable size in the body itself, for example for the in use receipt of a locking member in the form of an axially slidable pin.

In some embodiments, the axlebox key can also be retrofittable to a prior art pedestal leg of a sideframe which uses the bolted-type retaining key of the prior art. The prior art bolt can simply be discarded and the locating projection on the underside of the key can be positioned into the cored hole in the pedestal that is currently used to accept the bolt and nut of the prior art fastening arrangement.

In a second aspect, the present invention provides an assembly comprising:

- a pedestal leg of a sideframe of a rail wagon bogie, the leg comprising a side wall incorporating a through-hole and a flange extending from the side wall;
- an axlebox retainer key located on the flange, the key comprising a body having an upper side and an underside; a projection which extends from the underside of the body for location in a cavity or a hole formed in the pedestal leg so as to position the key on the pedestal; and a retaining formation formed at the upper side of the body and defining a transverse groove, which is arranged to extend across the key, the transverse groove being shaped for receipt of a locking member when present, in use for maintaining the key at the pedestal leg; and
- a fastening arrangement for fastening the axlebox retainer key to the pedestal leg and limiting movement of the axlebox retainer key with respect to the pedestal leg, the fastening arrangement comprising a locking member for securing the key to the pedestal leg, the locking member being an elongate pin which is arranged to be displaced axially when moved into the locking position via the through-hole arranged in the side wall.

One advantage of using a locking member which passes through the side wall of the sideframe of the bogie is that access to the locking member and the key is from the front of the sideframe, and so there is no need for an operator to kneel on the ground or to hold a tool in an inverted position in order to free the axlebox key from the sideframe. In the conventional prior art arrangement, access to the nut and bolt occurs from directly underneath the sideframe, which can be awkward and occupationally dangerous. Also, when the key is loosened it can then fall out and possibly injure a worker operating underneath the pedestal. To avoid this, sometimes two persons are required in the prior art key maintenance procedure. Embodiments of the assembly of the present invention can thus make maintenance of the wheelsets easier and safer.

In one embodiment, the key can further comprise a retaining formation which receives the locking member when the locking member is in the locking position. In one form the retaining formation is a recess arranged at, or a through-hole arranged in, the key.

In one embodiment, the locking member can be an elongate pin which is arranged to be displaced axially when moved into the locking position. In one form of this, the axial displacement can involve horizontally sliding the pin into the through-hole arranged in the side wall of the pedestal leg, and then into the recess or through-hole at the key. In other forms the locking member need not be a pin, and need not be horizontally slidingly received. For example the locking member can be a screw that may be threadingly received into the recess or through-hole, and which can be introduced at an angle that is not horizontally oriented (ie. orthogonal) with respect to the side wall. In still other forms, the locking member can be of shapes other than a pin, for example a flat strip.

In one embodiment, the assembly can further comprise a securing member that is securable to the pedestal leg and which maintains the locking member in the locking position, for example by preventing the locking member from sliding out of the through-hole in the pedestal or out of the recess in the key. In one form of this, the securing member may be secured by one or more lugs that are arranged at the side wall of the pedestal leg.

In one arrangement, the or each lug can have a through-hole arranged for the in use receipt of the securing member, and the or each lug through-hole can extend in a direction that is transverse to the direction of the side wall through-hole of the pedestal. In one form, the securing member can be arranged to be vertically slidingly received in the or each lug through-hole, although other angles are feasible.

In one embodiment, the securing member can be a clip (such as an R-clip) or a pin (such as a lynch pin, or a split pin). In one form, the clip or pin is arranged to be vertically slidingly received in a through-hole located in the locking member, said through-hole being aligned in use with the or each lug through-hole. In still other arrangements, the clip or pin can be secured by other types of fasteners, latches or friction-fit components.

In an alternative embodiment, the or each lug can define a recess arranged for the in use receipt of the securing member. In this embodiment, the securing member is a radial arm which extends from the locking member, the radial arm arranged to be received in the or each lug recess upon axial rotation of the locking member. In some forms there can be two radial arms projecting from opposing sides of the locking member, each arm for receipt into a respective lug recess upon rotation of the locking member.

In one variation of this embodiment, a spring can be located circumferentially about that portion of the locking member which projects from the pedestal side wall, the spring being arranged in use to bias the radial arm(s) away from the pedestal leg and thus into the or each lug recess. In this way, the spring functions to engage the or each arm quite tightly in a respective lug recess, and effort is required to depress the radial arm(s) towards the pedestal leg at the same time as rotating the locking member in order to remove the radial arms from the lug recesses. This version of the securing member still has the advantage that access to the locking member and the key is from the front of the sideframe, and so there is no need for an operator to be in a difficult or dangerous work position to be able free the axlebox key from the sideframe. However the more complex mechanism of depressing and rotating the securing members can limit casual tampering with the assembly by a passer-by or vandal.

In one form, the locking member can be tied to the pedestal leg so that, whether the locking member is or is not positioned in the locking position, it remains tied to the pedestal leg. For example the locking member can be secured by a length of metal wire, chain or cable (for example, stainless steel wire) which at one end is secured through an eyelet in the locking member, and where the other end of the wire, chain or cable is looped around a lug or other attachment positioned at the pedestal leg. In still other forms, the other end of the wire, chain or cable can be directly welded, bolted or otherwise fastened at the pedestal leg. In either circumstance, the clip is always located in proximity to the lugs when not fitted therein, in use. Attaching the clip to the sideframe makes the clip easy to locate and more difficult to lose.

In a third aspect, the present invention provides an axlebox retainer key assembly comprising an axlebox retainer key as defined in the first aspect and a locking member.

In one embodiment, the assembly also comprises a securing member as defined in the second aspect.

In one embodiment, the assembly also comprises one or more lugs as defined in the second aspect.

In a fourth aspect, the present invention provides a method of fastening an axlebox retainer key to a pedestal leg portion of a sideframe of a rail wagon bogie in which the pedestal leg comprises a side wall and a flange extending therefrom at which the key is located in use, the method comprising the steps of:

locating a projection on the key in a cavity or a hole formed in the pedestal leg so as to locate the key in position on the pedestal; and then moving a locking member via a through-hole arranged in the side wall into a locking position to secure the key to the pedestal.

In one embodiment of the method, the axlebox retainer key is as otherwise defined in the first aspect.

In one embodiment of the method, the resulting assembly is as otherwise defined in the second aspect.

In one embodiment of the method, the axlebox key can be retro-fittable to a prior art pedestal leg of a sideframe which previously used the nut and bolt retaining arrangement. In such a circumstance, when the locking member (such as a horizontal removable pin) is to be used, the pedestal leg will need one or possibly two holes to be drilled into the or each parallel side wall of the pedestal leg to accept the locking member, as well as perhaps a requirement to weld lugs onto the pedestal leg outer side wall.

BRIEF DESCRIPTION OF THE DRAWINGS

In order to facilitate a better understanding of the nature of the present invention a preferred embodiment of an axlebox retainer key and a fastening arrangement for such a key at a wagon sideframe will now be described in some detail, by way of example only, with reference to the accompanying drawings in which.

DETAILED DESCRIPTION OF PREFERRED EMBODIMENTS

Figure 1:
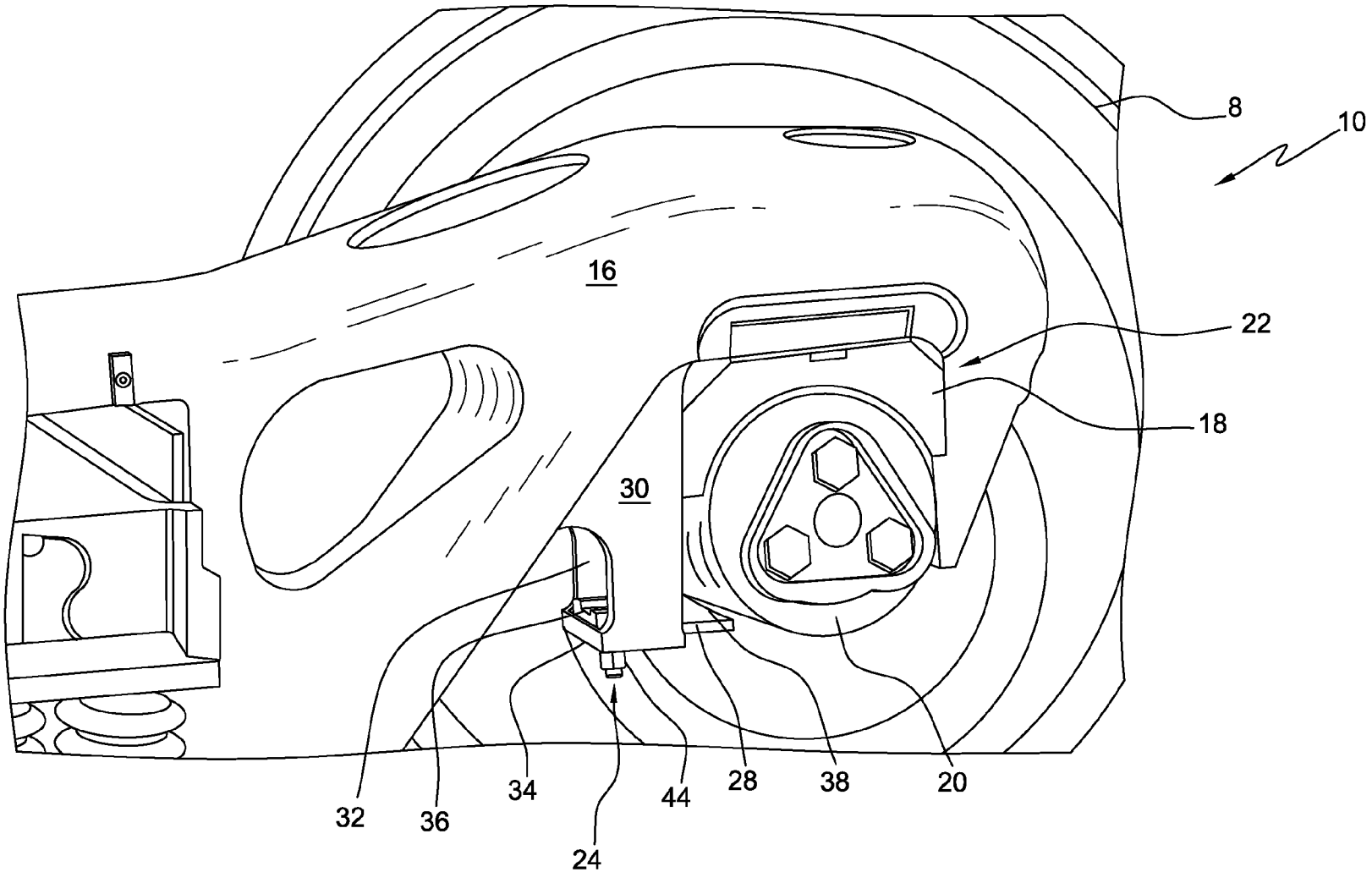
FIG. 1 (PRIOR ART)
FIG. 1 is a perspective view of a prior art arrangement of a portion of a rail wagon bogie sideframe fitted with an axlebox retainer key of the prior art type.
Figure 2:
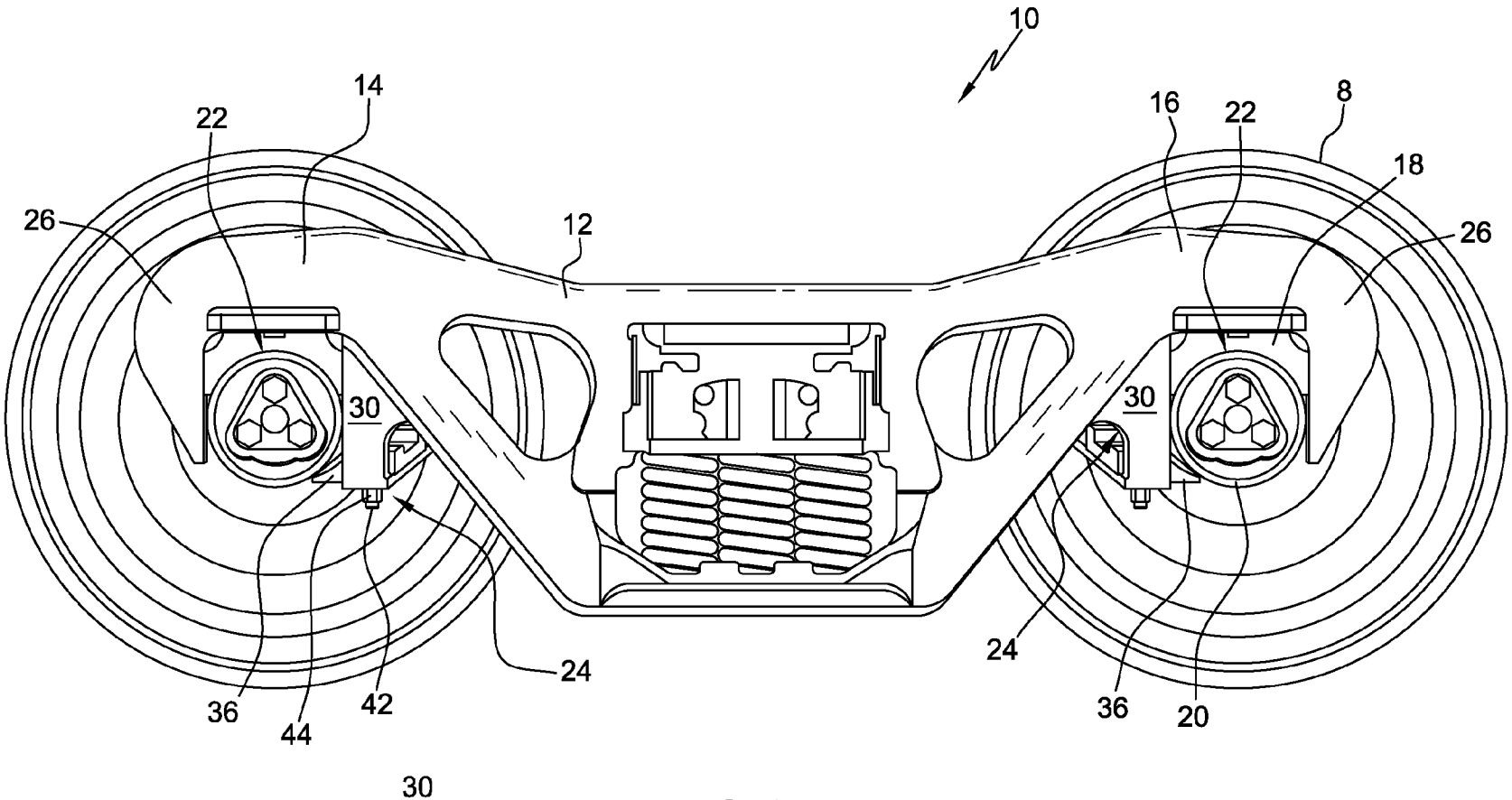
FIG. 2 (PRIOR ART)
FIG. 2 is a side elevation view of the full rail wagon bogie sideframe of which a portion only is shown in FIG. 1, the sideframe fitted with an axlebox retainer key of the prior art type.
Figure 3:
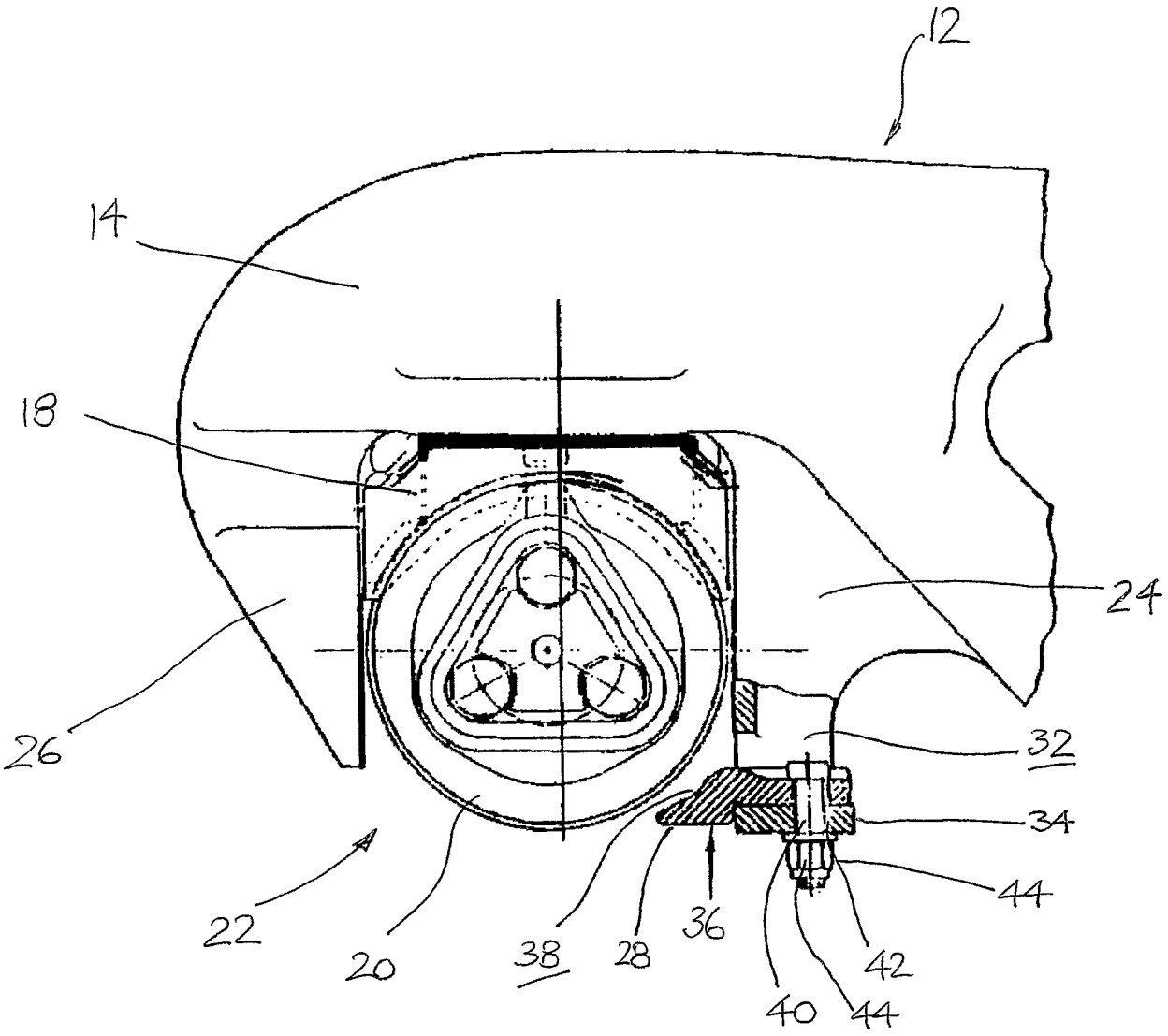
FIG. 3 PRIOR ART
FIG. 3 is a partially sectioned side elevation view of a portion of a rail wagon bogie sideframe as shown in FIG. 1, the sideframe fitted with an axlebox retainer key of the prior art type.

In the following detailed description, where reference is made to parts of a rail wagon bogie which are in all respects are the same as described in the foregoing Background to the Invention, these parts will be referred to by the same reference numerals already used. Where a reference is made to a part which has been modified in some way but is a part with an equivalent function described in the foregoing Background to the Invention, these parts will be referred to by the same reference numerals but with an additional apostrophe, for example pedestal leg 24'.

Also, when referring to various embodiments of the invention, in order to avoid repetition and for ease of reference, similar components and features of the alternative embodiments which have a similar function have been designated with an additional letter "A", "B", "C" etc, such as the axlebox key 50, 50A, 50B, and so on.

Figure 4:
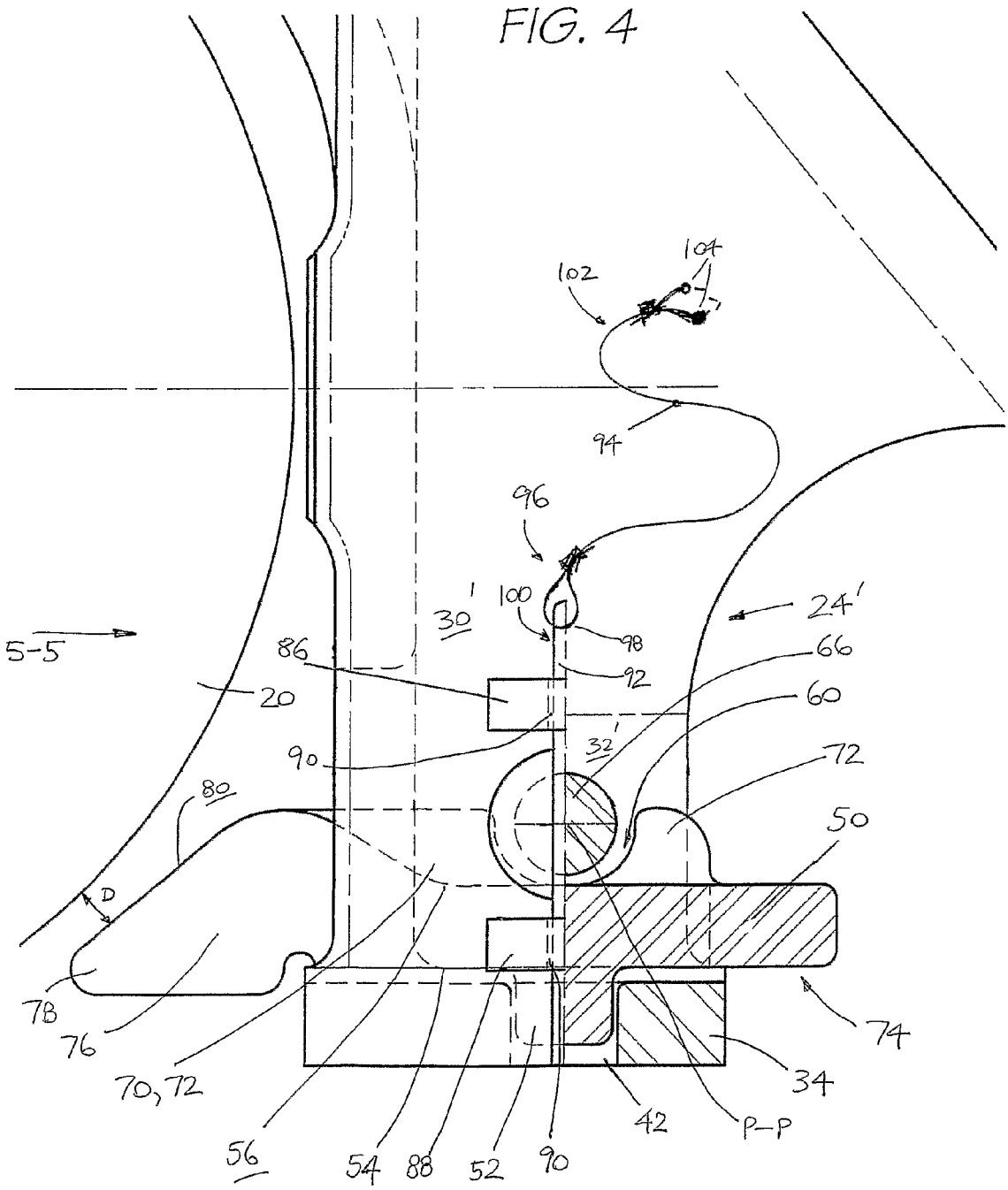
FIG. 4 is a partially sectioned side elevation view of an embodiment of an axlebox retainer key and an assembly including the key when located at a rail wagon bogie sideframe in accordance with the invention, the retainer key shown in position at a portion of a prior art pedestal leg of the sideframe, the pedestal leg having been modified as part of the assembly.
Figure 5:
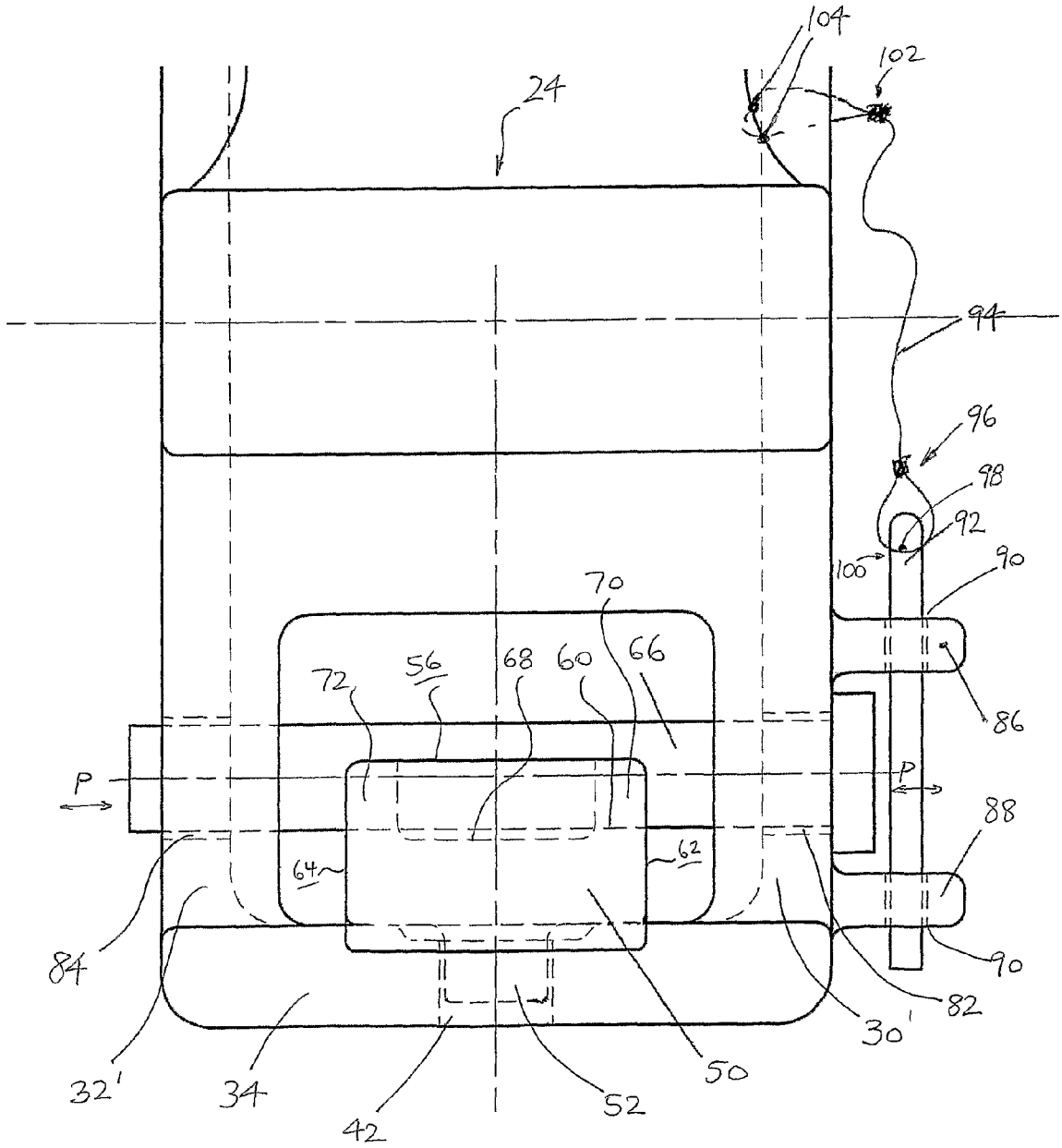
FIG. 5 is an end elevation view of the axlebox retainer key and assembly including the key as shown in FIG. 4 when viewed along the arrow 5-5.

Referring now to FIGS. 4 and 5, an axlebox retainer key 50 is shown when seated at a pedestal leg 24' of a sideframe 12 of a rail wagon bogie 10. The key 50 has a locating projection in the form of a cylindrical basal spigot 52 that is circular when viewed in plan, and which projects from an in use underside 54 of the key 50. When the key 50 is seated in position, the basal spigot 52 fits into the open hole 42 in the pedestal leg flange 34. This hole 42 is normally present to accept the bolt 40 of the bolt and nut 44 type prior art fastening arrangement. In this sense, the new axlebox retainer key 50 can be retrofitted to an existing sideframe pedestal leg 24. The basal spigot 52 shown is loosely interfitted into the open hole 42, but in other embodiments can tightly frictionally interfit with the open hole 42, in situations where there is close tolerance between an outer diameter of the spigot 52 and an inner diameter of the open hole 42.

The key 50 shown in FIGS. 4 and 5 is a unitary, integrally formed casting. In alternative arrangements the key can be formed by cutting from a single piece of metal or even by welding a number of pre-cut pieces of metal together, however casting is generally the easiest technique to form a key into complex shape using a mould.

The in use uppermost surface 56 of the key 50 features a retaining formation which is a recess in the form of a transverse groove 60 that is semi-circular in cross-section and which is arranged to extend from one side 62 to the opposite side 64 of the key 50. The transverse groove 50 is shaped for receipt of a locking member in the form of a round cylindrical pin 66, as part of the fastening arrangement which will shortly be described.

In other forms of the invention, the recess can be of other shapes for mating receipt of a pin of an alternative cross-sectional shape, for example in situations where the pin and recess are oval, triangular, square-shaped, strip-like or of other shapes in cross-section. In some other arrangements, the recess need not necessarily extend fully across the width of the key. In still other forms, the uppermost surface of the key may not feature a recess at all, and instead the key may have an inset through-hole, or even a closed hole (or cavity) for receipt of a pin (or the end of a pin) of any corresponding cross-sectional shape. In any of these examples, an elongate pin or other member is inserted in a generally axial movement across the upper surface of the key via a hole located in the front face of the inner pedestal leg 24', as will shortly be described.

The axlebox retainer key 50 is basically shaped as an elongate rectangular block or prism with a central, axial cutout 68 that is rectangular in cross-sectional shape and which extends over the length of the key 50 to define two raised wings or webs 70, 72 located at opposing sides 62, 64 of the key 50. The semi-circular transverse groove 60 is formed in each of these webs 70, 72 so that the pin 66 can freely slide across the uppermost surface 56 of the key 50. Towards one end region 74 of the key 50, the height of each web 70, 72 tapers smoothly downward so that the end region 74 of the key 50 is shaped as a rectangular flange. The opposing (head) end of the key 50 is shaped as a tang 76 with a snub nose 78. The tang 76 features an evenly-sloping, uppermost flat face portion 80. When the key 50 is positioned between the parallel side walls 30', 32' of the pedestal leg 24' and the spigot 52 is mounted in the hole 42, the tang 76 protrudes from the pedestal 24' toward the bearing 20. The flat face 80 of the tang 76 of the key 50 is arranged to be approximately tangential to, and located a small clearance D from, a peripheral edge of the bearing 20. The flat face 80 of the tang 76 bears against the bearing 20 when deployed, so as to retain the bearing and wheelset at the bogie.

In the embodiment shown in FIGS. 4 and 5, once seated at the flange 34, the axlebox retainer key 50 is fastened to the pedestal leg 24' by a locking member in the form of the elongate round pin 66 that is positioned to rest in the recesses 60 arranged in the webs 70, 72 of the key 50. During installation and removal, the pin 66 is moved into a locking position by an axial sliding movement via through-holes 82, 84 which are arranged in each of the respective side walls 30', 32' of the pedestal 24'. In other forms of the invention, the pin (or other type of locking member) can, for example, be received in a cavity within the key, as has been previously described.

In the form shown in the drawings, the elongate pin 66 is horizontally slidingly received via the through-hole 82 arranged in outermost side wall 30' of the pedestal leg 24', and then into the groove 60 that is located at the uppermost surface 56 of the key 50. An operator standing at the front region of the sideframe 12 needs merely to insert or withdraw the pin 66, without needing to bend down under the sideframe 12, or to lie on surrounding ground etc. In the embodiment shown, the pin extends across the key 50 and into a further through-hole 84 arranged in the other side wall 32' of the pedestal leg 24'. This location of the pin 66 across and above the axlebox key 50 prevents the key 50 from being lifted out of its seated position, by maintaining the recessed position of the basal spigot 52 in the hole 42.

In other embodiments, the fastening arrangement can employ another type of locking member, for example a non-sliding fastener such as a screw which may be threadedly received into a recess in the uppermost surface of the key and in the or each through-hole in the side wall(s) of the pedestal leg. In still other embodiments it is envisaged that the angle of the pin or other selected fastener need not be horizontally oriented with respect to the side wall of the pedestal leg, so long as operator access is maintained via the front region of the sideframe and the pedestal leg.

In order to secure the pin 66 in position in the pedestal leg 24', the external side wall 30' of the pedestal leg 24' is modified (for example by welding or cutting) to fit two like, protruding lugs 86, 88 thereonto. Each lug 86, 88 defines a central, vertically-oriented through-hole 90 which is aligned with the through-hole 90 of the respective other lug 86, 88. As shown in the drawings, in use a securing member in the form of an elongate R-clip 92 is inserted by a vertical sliding movement into each aligned through-hole 90. The R-clip 92 is thus secured to the exterior wall 30' of the pedestal leg 24' at the lugs 86, 88 and, when in position, the clip 92 is arranged to block the axial slide path P-P of the elongate pin 66. The vertically-oriented R-clip 92 maintains the pin 66 in the inserted locking position by preventing the pin 66 from being slidingly removed from its horizontal orientation in the groove 60 at the uppermost surface 56 of the key 50. The positioning of the elongate pin 66 in turn secures the axlebox key 50 at the pedestal leg 24'.

In other arrangements, the R-clip can be replaced by other equivalent types of fasteners, latches, pins or other types of friction-fit components, depending on the requirements.

As shown in the Figures, the R-clip 92 is separately secured to the pedestal leg 24' by a length of stainless steel metal wire 94. One end 96 of the wire 94 is secured through an eyelet 98 at an uppermost end 100 of the R-clip 92, and the other end 102 of the wire 94 is bolted to the outermost side wall 30' of the pedestal leg 24' by bolts 104 so that the R-clip 92 can always be located in proximity to the lugs 86, 88 when not inserted in the respective through-holes 90. In other arrangements, the metal wire 94 can be replaced by any appropriate linkage, such as a length of chain, cable or cord to retain the R-clip or other securing member at the pedestal leg 24'.

Figure 8:
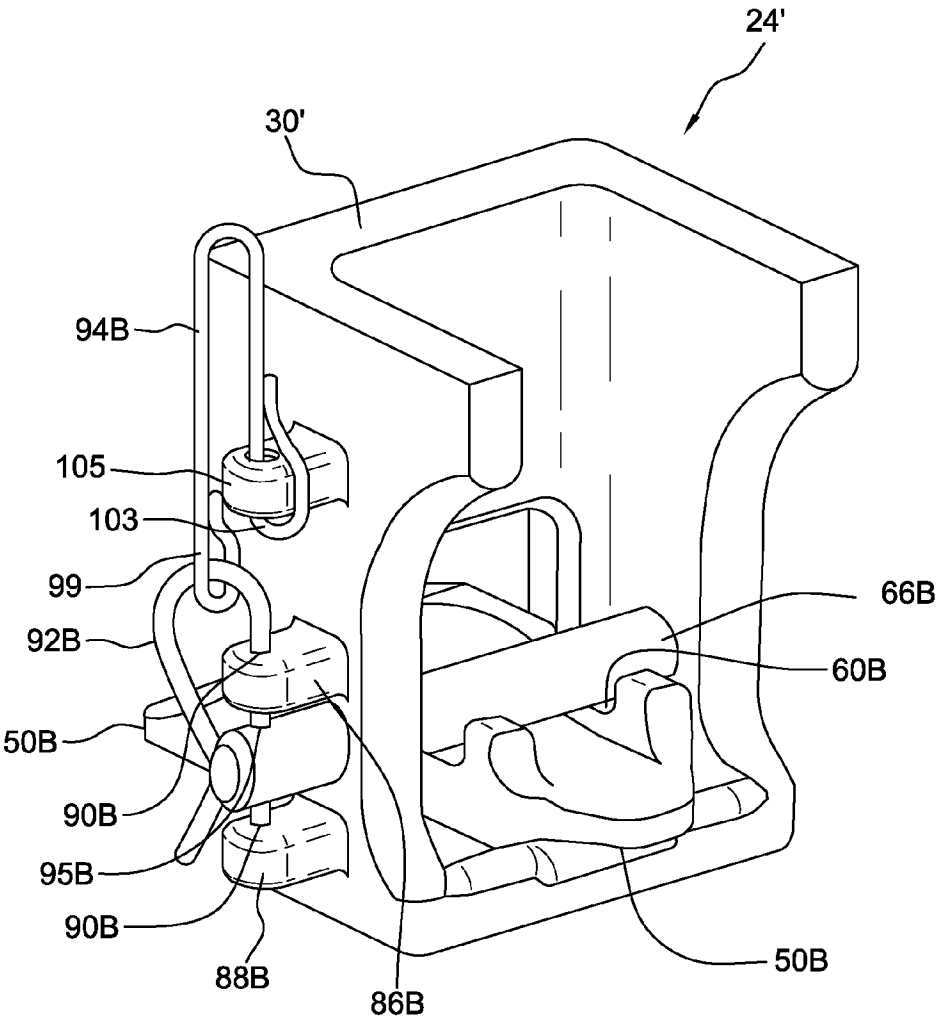
FIG. 8 is a perspective view of an embodiment of an axlebox retainer key and an assembly including the key when located at a rail wagon bogie sideframe in accordance with the invention, the retainer key shown in position at a portion of a prior art pedestal leg of the sideframe, the pedestal leg having been modified as part of the assembly.
Figure 9:
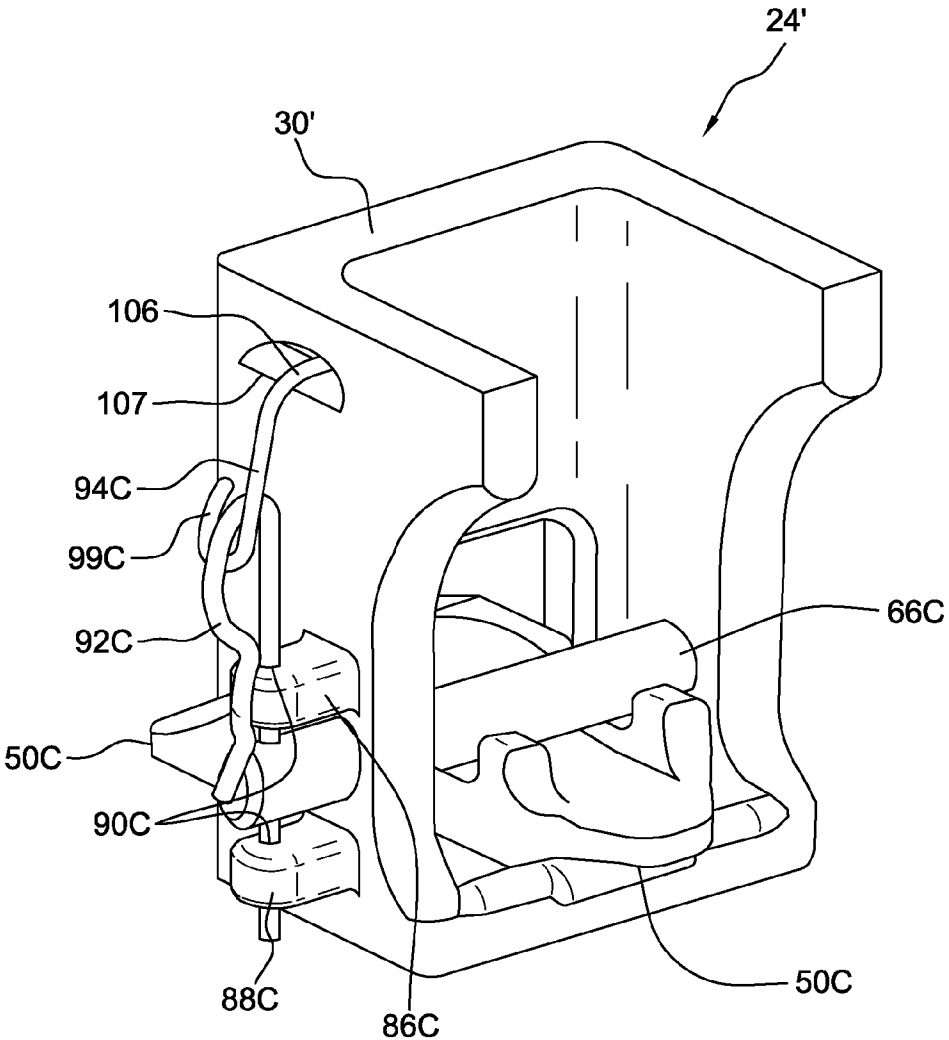
FIG. 9 is a perspective view of an embodiment of an axlebox retainer key and an assembly including the key when located at a rail wagon bogie sideframe in accordance with the invention, the retainer key shown in position at a portion of a prior art pedestal leg of the sideframe, the pedestal leg having been modified as part of the assembly.
Figure 10:
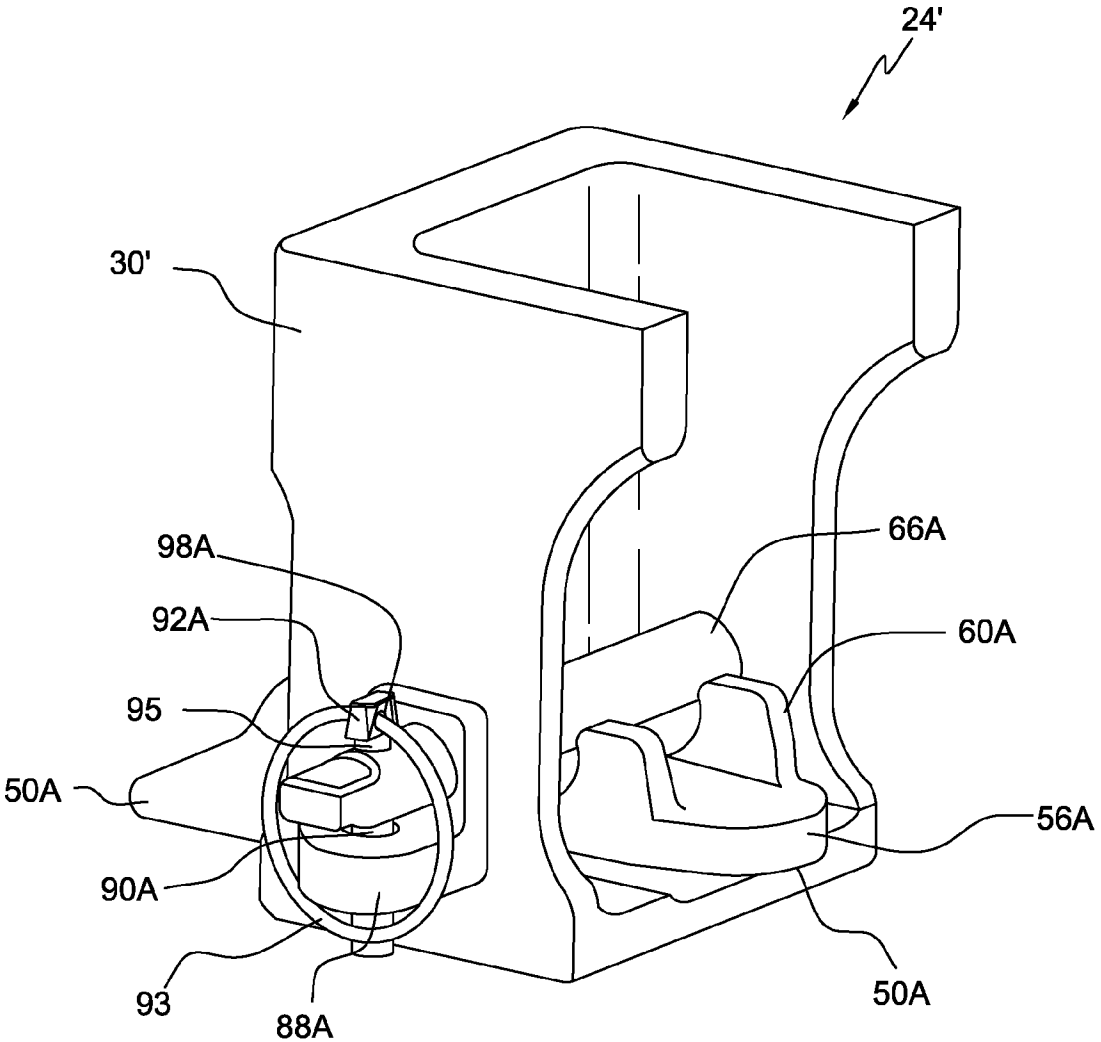
FIG. 10 is a perspective view of an embodiment of an axlebox retainer key and an assembly including the key when located at a rail wagon bogie sideframe in accordance with the invention, the retainer key shown in position at a portion of a prior art pedestal leg of the sideframe, the pedestal leg having been modified as part of the assembly.

Further arrangements to secure the locking member in position at the pedestal leg 24' are provided in FIGS. 8, 9 and 10. In each of these embodiments the external side wall 30' of the pedestal leg 24' is modified to fit at least one protruding lug thereonto. These lug(s) are then used in various ways to provide a fastening arrangement for a locking member to lock the axlebox key in position.

In FIG. 10 a single lug 88A defines a central, vertically-oriented through-hole 90A in which a securing member in the form of a lynch pin 92A is inserted by a vertical sliding movement. The lynch pin 92A is deployed upwardly or downwardly by gripping the ring 93 by hand, the ring being pivotably secured through an eyelet 98A at an uppermost end of the lynch pin 92A. In use the hole 90A in the lug 88A is aligned with a through-hole 95 which is arranged in the pin 66A. The pin 66A is thus secured to the exterior wall 30' of the pedestal leg 24' via the lug 88A, and the pin 66A cannot be axially slidingly removed from its horizontal orientation in the groove 60A at the uppermost surface 56A of the key 50A until the lynch pin 92A has been lifted out of position. The positioning of the elongate pin 66A in turn secures the axlebox key 50A at the pedestal leg 24'. In one form, the lynch pin 92A can be arranged to have a raised surface dimple so it is held in a frictional engagement with an interior of one of the holes 90A, 95.

In FIG. 8 two lugs 86B, 88B each define a central, vertically-oriented through-hole 90B in which a securing member in the form of an R-clip 92B is inserted by a vertical sliding movement. The R-clip 92B is deployed upwardly or downwardly by being sufficiently deformed so that it can move past the lug 86B. In use the holes 90B in the lugs 86B, 88B are aligned with a through-hole 95B which is arranged in the pin 66B. The pin 66B is thus secured to the exterior wall 30' of the pedestal leg 24' via the lugs 86B, 88B, and the pin 66B cannot be axially slidingly removed from its horizontal orientation in the groove 60B at the uppermost surface 56B of the key 50B until the R-clip 92B has been lifted out of position. The R-clip 92B is separately secured to the pedestal leg 24' by a length of stiff metal wire 94B. An eyelet 99 at one end of the wire 94B is looped about the R-clip 92, and an further eyelet 103 at the respective other end of the wire 94B is clipped to the outermost side wall 30' of the pedestal leg 24' at a third lug 105 so that the R-clip 92B can always be located in proximity to the lugs 86B, 88B when not inserted in the respective through-holes 90B.

The embodiment shown in FIG. 9 is in all respects similar to the embodiment shown in FIG. 8 except that the stiff metal wire 94C which secures the R-clip 92C to the pedestal leg 24' is arranged to pass through the outermost side wall 30' of the pedestal leg 24' via a further hole 107 therethrough. The end of the wire 94C is then retained or secured on the other side of the side wall 30' (that is, on an opposite side of the wall 30' to the location of the lugs 86C, 88C). The wire 94C is shown as being retained on that opposite side of the side wall by a suitably sized T-section formation 106 arranged the end of the wire on that side. The T-section 106 of wire is of a size which cannot pass through the pedestal side wall hole 107. In this way the R-clip 92C can always be located in proximity to the lugs 86C, 88C when not inserted in the respective through-holes 90C.

Figure 11:
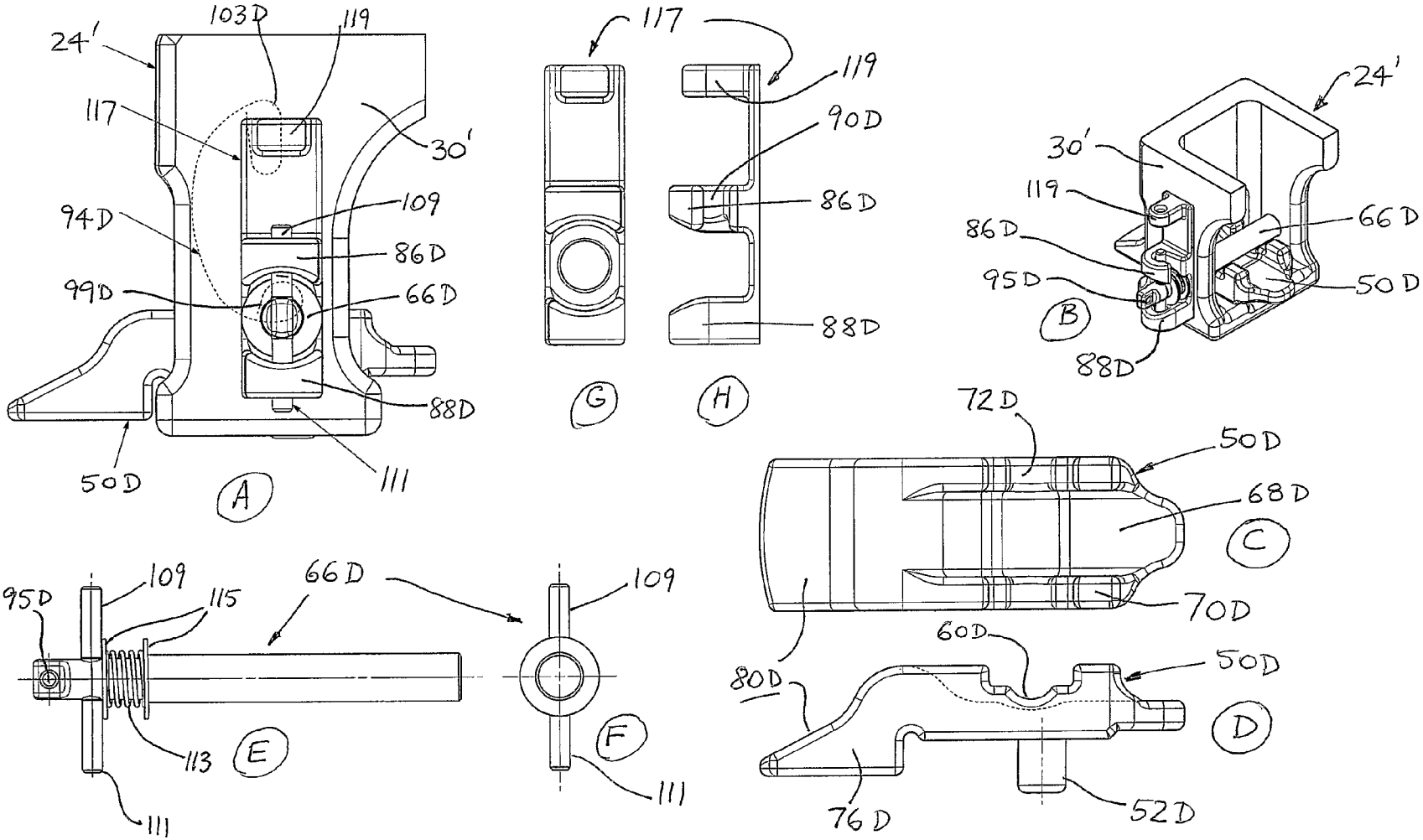
FIG. 11A is a side elevation view of an embodiment of an axlebox retainer key and an assembly including the key and a locking member when located at a rail wagon bogie sideframe in accordance with the invention, the retainer key shown in position at a portion of a prior art pedestal leg of the sideframe, the pedestal leg having been modified as part of the assembly.
FIG. 11B is a perspective view of the axlebox retainer key and assembly including of FIG. 11A.
FIG. 11C is a plan view of the axlebox retainer key shown in FIGS. 11A and 11B.
FIG. 11D is a side elevation view of the axlebox retainer key of FIG. 11C.
FIG. 11E is a plan view of the locking member of the assembly of FIGS. 11A and 11B.
FIG. 11F is an end elevation view of the locking member of FIG. 11E.
FIG. 11G is an end elevation view of a component which includes two lugs which each define a recess and one lug that defines a through-hole, the component suitable for fitting at the side wall of the pedestal leg.
FIG. 11H is a side elevation view of the component of FIG. 11G.

Referring now to FIG. 11, the locking pin 66D comprises two radially extending arms 109, 111 which project from opposite sides of the locking pin 66D and which are arranged to be received in the recess of a respective lug 86D, 88D upon axial rotation of the locking pin 66D. In some embodiments, the arms 109, 111 can be moved into an interference fit with the respective recess 90D of the lugs 86D, 88D, and the arms 109, 111 can be removed from the lug recesses 90D by application of force in a counter rotational movement.

In the embodiment shown in FIG. 11, a spring 113 is also located circumferentially about that end of the locking pin 66D which is located outside of the pedestal side wall 30' in use, and between the side wall 30' and the arms 109, 111. Either end of the spring 113 is contacted with a respective washer plate 115 which can assist in preventing migration of the spring 113. The spring 113 biases the position of the arms 109, 111 away from the pedestal side wall 30' and thus into the respective lug recesses 90D. The spring functions to engage each arm 109, 111 quite tightly in a recess 90D of a respective lug 86D, 88D, and some effort is required by a maintenance worker to depress the radial arm(s) in a direction towards the pedestal side wall 30' at the same time as rotating the locking pin 66D, so as to disengage and remove the radial arms 109, 111 from their respective positions in the lug recesses 90D.

The spring 113 also helps absorb vibration and rattling noise while the pin 66D is in the locking position.

FIG. 11 also shows a single casting 117 which includes three lugs 86D, 88D, 119 which can be retrofitted to the existing sideframe pedestal side wall 30'. As shown in FIG. 11A, the locking pin 66D is separately secured to the pedestal leg 24' by a length of flexible metal cable 94D. An eyelet 99D at one end of the wire 94D is looped through a hole 95D located at the end region of the locking pin 66D, and a further eyelet 103D at the respective other end of the cable 94D is clipped to the outermost side wall 30' of the pedestal leg 24' at a hole defined by the third lug 119. Thus the locking pin 66D can always be located in proximity to the lugs 86D, 88D when not inserted in the respective recesses 90D.

Figure 7:
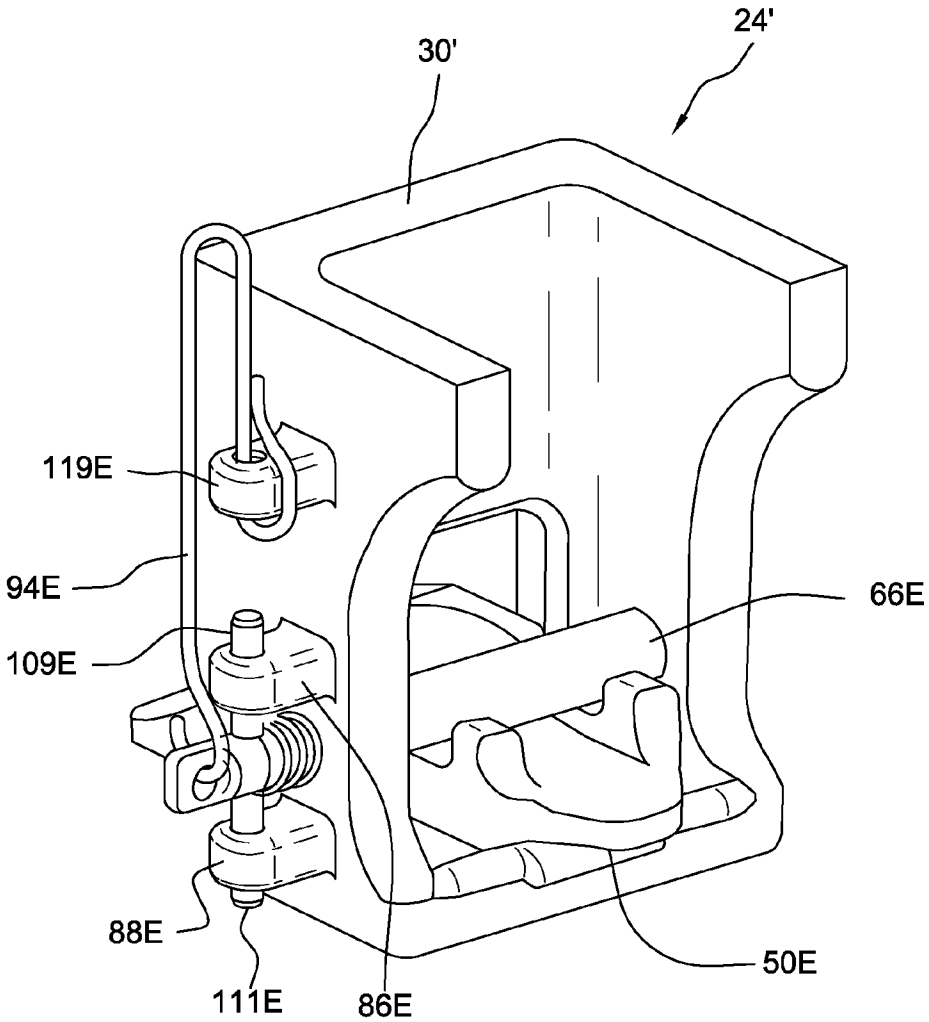
FIG. 7 is a perspective view of an embodiment of an axlebox retainer key and an assembly including the key when located at a rail wagon bogie sideframe in accordance with the invention, the retainer key shown in position at a portion of a prior art pedestal leg of the sideframe, the pedestal leg having been modified as part of the assembly.

The embodiment shown in FIG. 7 is in all respects quite similar to the embodiment shown in FIG. 11 with the exception that rather than a single casting which includes three lugs retrofitted to existing sideframe pedestal side wall 30', the embodiment in FIG. 7 shows an arrangement of three discrete lugs 86E, 88E, 119E which are separately attached to the side wall 30'. Also in FIG. 7, rather than securing the locking pin 66E to the pedestal leg 24' by using a length of flexible metal cable or the like, a length of stiff metal wire 94E is used in a similar manner as previously described for the embodiment shown in FIG. 8.

Figure 12:
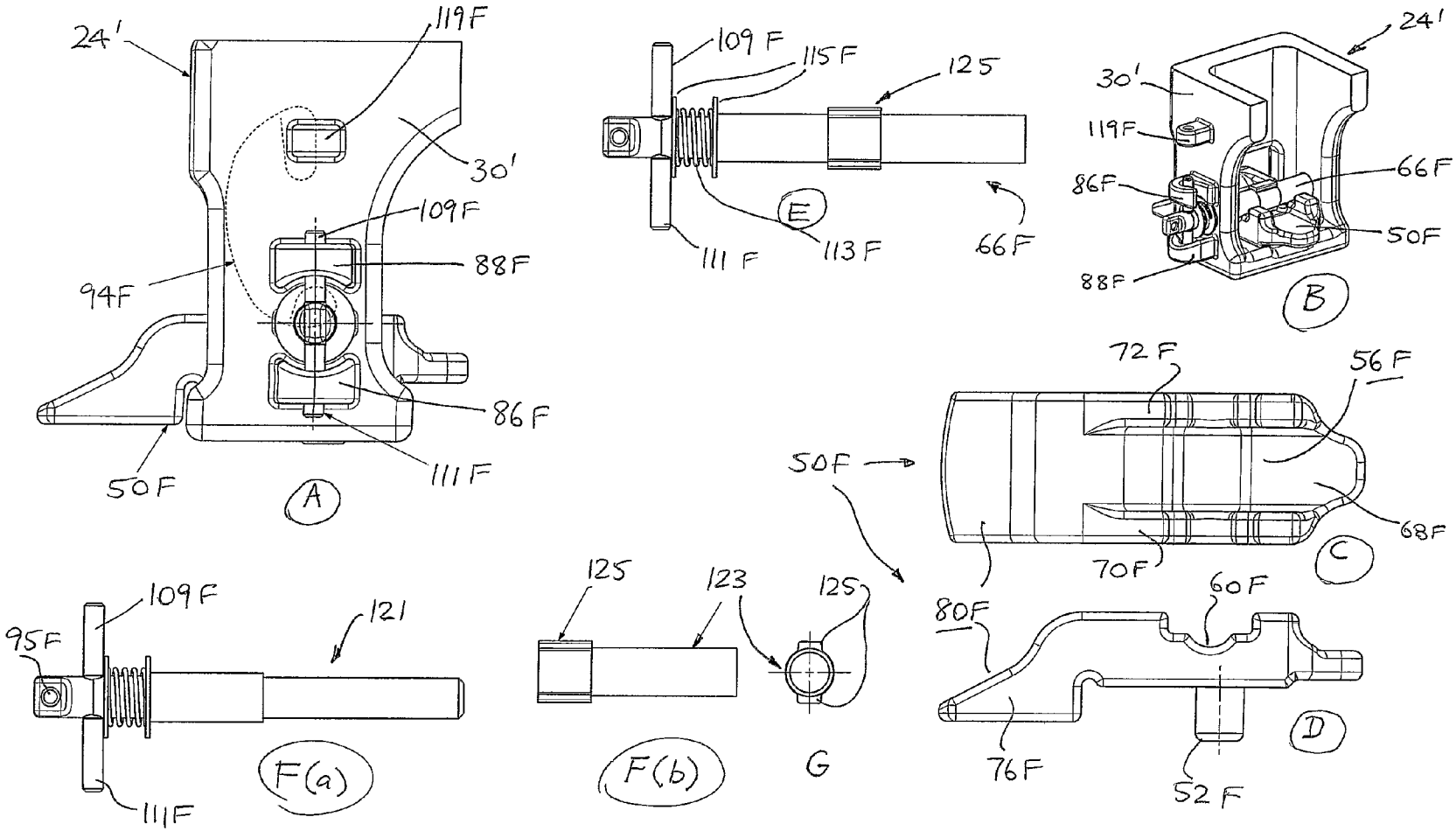
FIG. 12A is a side elevation view of an embodiment of an axlebox retainer key and an assembly including the key and a locking member when located at a rail wagon bogie sideframe in accordance with the invention, the retainer key shown in position at a portion of a prior art pedestal leg of the sideframe, the pedestal leg having been modified as part of the assembly.
FIG. 12B is a perspective view of the axlebox retainer key and assembly of FIG. 12A.
FIG. 12C is a plan view of the axlebox retainer key shown in FIGS. 12A and 12B.
FIG. 12D is a side elevation view of the axlebox retainer key of FIG. 12C.
FIG. 12E is a plan view of the locking member of the assembly of FIGS. 12A and 12B.
FIG. 12F is a plan view of the locking member of FIG. 12E when shown as separated into its two component parts, being a shaft (12F(a)) and a bush (12F(b)) fitted with an elastomeric sleeve or moulding.
FIG. 12G is an end elevation view of the bush shown in FIG. 12F(b).

Referring now to FIG. 12, the embodiment shown is in all respects similar to the embodiment shown in FIG. 11 except where FIG. 11 showed a single casting which included three lugs for retrofitting to an existing pedestal side wall 30'. In this respect the embodiment shown in FIG. 12 is more similar to that described in FIG. 7, and features three discrete lugs 86F, 88F, 119F which are separately attached to the side wall 30'.

FIG. 12E shows the locking pin 66F. FIGS. 12F(a) and 12F(b) show the two constituent parts of that locking pin 66F. The pin 66F comprises a shaft assembly 121 and a bush 123 which is arranged to slidingly receive the shaft assembly 121 thereinto. The bush 123 is fitted with an external elastomeric sleeve or moulding 125 which is keyed thereto and which in use can be positioned between the assembled pin 66F and the upper surface 56F of the axlebox key 50F to absorb vibration and rattling of the key 50F when in use, as well as to more tightly secure the key 50F at the pedestal 24'.

Figure 6:
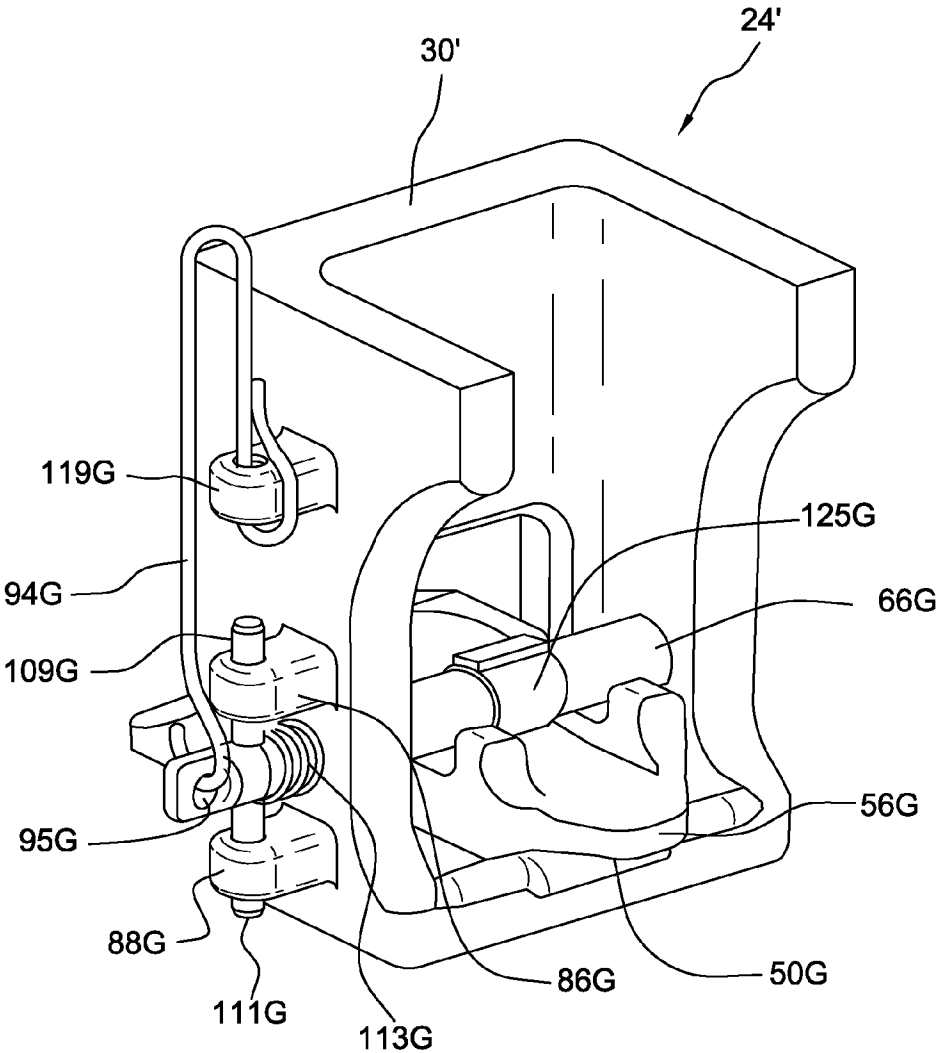
FIG. 6 is a perspective view of an embodiment of an axlebox retainer key and an assembly including the key when located at a rail wagon bogie sideframe in accordance with the invention, the retainer key shown in position at a portion of a prior art pedestal leg of the sideframe, the pedestal leg having been modified as part of the assembly.

The embodiment shown in FIG. 6 is in all respects quite similar to the embodiment shown in FIG. 12 including the two-part locking pin 66G which features an external elastomeric sleeve or moulding 125G. However, rather than securing the locking pin 66G to the pedestal leg 24' by using a length of flexible metal cable or the like, in the embodiment shown in FIG. 6 a length of stiff metal wire 94G is used in a similar manner as previously described for the embodiments shown in FIGS. 7 and 8.

Referring back to the embodiment shown in FIGS. 4 and 5 (although it is to be understood that the method is applicable to each of the embodiments described hereinbefore) to install the key 50, an operator first positions the basal projection 52 of the key 50 in the cavity or a hole 42 that is formed in the pedestal leg 24, and then moves the locking pin 66 across the key 50 via the through-hole 82 in the side wall 30 so as to secure the key 50 to the pedestal 24. The basal projection acts as a guide for the initial step of locating the key in position at the pedestal and can also be used to limit any movement of the key relative to the pedestal (either sideways or vertical) when used in combination with the locking pin 66. When a maintenance interval is called for, the specific configuration of the axlebox key and its fastening arrangement described lends itself to easier maintenance handling procedures and a decreased risk of worker injury. The removal of the key 50 then becomes a simple matter of vertically withdrawing the securing member (such as an R-clip 92), and then removing the elongate locking pin 66 by horizontally hand-sliding towards the operator, who can be standing at the outside front region of the bogie sideframe 12. This design means that no mechanical device or tool is required to remove the retaining key, and that there is no need for an operator to kneel on the ground or to hold an impact gun etc, to adjust nuts and bolts, as was the difficulty in the prior art arrangement.

Now that a preferred embodiment of the invention has been described in some detail it will be apparent to those skilled in the art that the axlebox retainer key and its fastening arrangement has at least the following advantages:

(i) there is no need for a nut and bolt type fastening arrangement for the key;

(ii) the basal spigot (or another projection) assists in the secure location of the key at the pedestal;

(iii) no mechanical device or tool is required to remove the retaining key, so that there is no need for an operator to operate in an awkward position for loosening or tightening of any fasteners, which can be occupationally dangerous; and (iv) maintenance of the wheelsets can be easier, safer and more economical than previously known.

Those skilled in the art will appreciate that the invention described herein is susceptible to variations and modifications other than those specifically described. For example, in other arrangements it is envisaged that the same type of axlebox retainer key can be fitted to the outermost pedestal leg 26 rather than only onto the inner leg 24. Also, although the particular orientation and configuration of a locking member and a fastener have been described in a preferred orientation, these types of fasteners may be oriented in a variety of dispositions relative to the pedestal leg and the axlebox key. Any shape of axlebox key is also within the scope of the invention, and need not be restricted to the snub-nosed form shown in most of the embodiments.

All such variations and modifications are to be considered within the scope of the present invention the nature of which is to be determined from the foregoing description. It is to be understood that, if any prior art information is referred to herein, such reference does not constitute an admission that the information forms a part of the common general knowledge in the art in any country.

The invention claimed is:

1. An axlebox retainer key for fitting to a pedestal leg of a sideframe of a rail wagon bogie, the key comprising:

a body having an upper side and an underside;

a locating projection which extends from the underside of the body for location in a cavity or hole which is formed in the pedestal leg; and a retaining formation formed at the upper side of the body and defining a transverse groove, which is arranged to extend across the key.

2. An axlebox retainer key as claimed in claim 1 wherein the projection is integral with the body.

3. An axlebox retainer key as claimed in claim 1 wherein the projection is welded or otherwise formed integral with the body.

4. An axlebox retainer key as claimed in claim 1 wherein the projection is a basal spigot located on an underside of the body.

5. An axlebox retainer key as claimed in claim 1 wherein the groove is adapted to inhibit removal of the projection from the cavity when a locking member is received in the groove.

6. An axlebox retainer key as claimed in claim 1 wherein the groove is a through-hole arranged for the in use receipt of a locking member.

7. An axlebox retainer key assembly comprising an axlebox retainer key as claimed in claim 1, further comprising a locking member for limiting movement of the key with respect to the pedestal leg when received in the transverse groove.

8. An axlebox retainer key assembly as claimed in claim 7, further comprising a securing member that is securable to the pedestal leg and which maintains the locking member in the locking position.

9. An axlebox retainer key assembly as claimed in claim 8, further comprising one or more lugs that are arranged at the side wall of the pedestal leg for securing the securing member.

10. An assembly comprising:

a pedestal leg of a sideframe of a rail wagon bogie, the leg comprising a side wall incorporating a through-hole and a flange extending from the side wall;

an axlebox retainer key located on the flange, the key comprising:

a body having an upper side and an underside;

a projection which extends from the underside of the body for location in a cavity or a hole formed in the pedestal leg so as to position the key on the pedestal; and a retaining formation formed at the upper side of the body and defining a transverse groove, which is arranged to extend across the key; and a fastening arrangement for fastening the axlebox retainer key to the pedestal leg and limiting movement of the axlebox retainer key with respect to the pedestal leg, the fastening arrangement comprising a locking member for securing the key to the pedestal leg when received in the transverse groove, the locking member being an elongate pin which is arranged to be displaced axially when moved into the locking position via the through-hole arranged in the side wall.

11. An assembly as claimed in claim 10 wherein the key further comprises a retaining formation which receives the locking member when the locking member is in the locking position.

12. An assembly as claimed in claim 10 wherein the axial displacement involves horizontally sliding the pin into the through-hole.

13. An assembly as claimed in claim 10 further comprising a securing member that is securable to the pedestal leg and which maintains the locking member in the locking position.

14. An assembly as claimed in claim 10 wherein the locking member is tied to the pedestal leg so that, whether the locking member is or is not positioned in the locking position, it remains tied to the pedestal leg.

15. An assembly comprising:

a pedestal leg of a sideframe of a rail wagon bogie, the leg comprising a side wall incorporating a through-hole and a flange extending from the side wall;

an axlebox retainer key located on the flange, the key comprising a projection which locates in a cavity or a hole formed in the pedestal leg so as to position the key on the pedestal;

a fastening arrangement for fastening the axlebox retainer key to the pedestal leg, the fastening arrangement comprising a locking member for securing the key to the pedestal leg, the locking member being moveable into a locking position via the through-hole arranged in the side wall;

a securing member that is securable to the pedestal leg and which maintains the locking member in the locking position; and wherein the securing member is secured by one or more lugs that are arranged at the side wall of the pedestal leg.

16. An assembly as claimed in claim 15 wherein each lug has a through-hole arranged for the in use receipt of the securing member.

17. An assembly as claimed in claim 16 wherein each lug through-hole extends in a direction that is transverse to the direction of the side wall through-hole.

18. An assembly as claimed in claim 16 wherein the securing member is arranged to be vertically slidingly received in each lug through-hole.

19. An assembly as claimed in claim 15 wherein the one or more lugs define a groove arranged for the in use receipt of the securing member.

20. An assembly as claimed in claim 19 wherein the securing member is a radial arm extending from the locking member, and the radial arm is arranged to be received in the one or more lug grooves upon axial rotation of the locking member.

21. An assembly as claimed in claim 20 wherein a spring is located circumferentially about a portion of the locking member and is arranged in use to bias the radial arm away from the pedestal leg and into the one or more lug grooves.

22. An assembly comprising:

a pedestal leg of a sideframe of a rail wagon bogie, the leg comprising a side wall incorporating a through-hole and a flange extending from the side wall;

an axlebox retainer key located on the flange, the key comprising a projection which locates in a cavity or a hole formed in the pedestal leg so as to position the key on the pedestal;

a fastening arrangement for fastening the axlebox retainer key to the pedestal leg, the fastening arrangement comprising a locking member for securing the key to the pedestal leg, the locking member being moveable into a locking position via the through-hole arranged in the side wall;

a securing member that is securable to the pedestal leg and which maintains the locking member in the locking position; and wherein the securing member is a clip or pin.

23. An assembly as claimed in claim 22, wherein the securing member is secured by one or more lugs arranged at the side wall of the pedestal leg, wherein the clip or pin is arranged to be vertically slidingly received in a through-hole located in the locking member, and wherein each of the one or more lugs has a through-hole for receipt of the securing member, said locking member through-hole being aligned in use with the one or more lug through-holes.

24. A method of fastening an axlebox retainer key to a pedestal leg portion of a sideframe of a rail wagon bogie in which the pedestal leg comprises a side wall and a flange extending therefrom at which the key is located in use, the key comprising:

a body having an upper side and an underside;

a locating projection which extends from the underside of the body for location in a cavity or hole which is formed in the pedestal leg;

a retaining formation formed at the upper side of the body and defining a transverse groove, which is arranged to extend across the key; and the method comprising:

locating the projection, which extends from the underside of the body on the key in the cavity or the hole formed in the pedestal leg so as to locate the key in position on the pedestal; and moving, after the locating, a locking member via a through-hole arranged in the side wall, into the transverse groove extending across the key, and into a locking position to secure the key to the pedestal limiting movement of the key with respect to the pedestal leg.

25. A method as claimed in claim 24 wherein the assembly comprises:

the pedestal leg of the sideframe, the leg comprising a side wall incorporating a through-hole and a flange extending from the side wall; and the axlebox retainer key located on the flange, the key comprising a projection which locates in a cavity or a hole formed in the pedestal leg so as to position the key on the pedestal.

26. An axlebox retainer key for fitting to a pedestal leg of a sideframe of a rail wagon bogie, the key comprising:

a body;

a locating projection which extends from the body for location in a cavity or hole which is formed in the pedestal leg;

a retaining formation formed at the body and defining a groove arranged to receive a locking member, in use for maintaining the key at the pedestal leg and limiting movement of the key with respect to the pedestal leg;

wherein the projection is a basal spigot located on an underside of the body; and wherein the said groove is arranged on an in use upper side of the body.

27. An axlebox retainer key for fitting to a pedestal leg of a sideframe of a rail wagon bogie, the key comprising:

a body having an upper side and an underside;

a locating projection which extends from the underside of the body for location in a cavity or hole which is formed in the pedestal leg; and a retaining formation formed at the upper side of the body and defining a transverse groove, which is arranged to extend across the key;

wherein the body includes a plurality of spaced apart raised formations that extend along the upper side, and wherein the raised formations include respective cut-outs that form the transverse groove of the retaining formation.

* * * * *